US005332140A

United States Patent [19]

Almeras et al.

[11] Patent Number: 5,332,140

[45] Date of Patent: Jul. 26, 1994

[54] APPARATUS FOR APPLYING FIXING ELEMENTS, WITH PLUNGER, PLUNGER RETURN CATCH AND PIVOTING PLUG GUIDE

[75] Inventors: Roland Almeras; Patrick Herelier, both of Tournon, France

[73] Assignee: Societe de Prospection et d'Inventions Techniques (S.P.I.T.), Bourg-Les-Valence Cedex, France

[21] Appl. No.: 50,798

[22] Filed: Apr. 22, 1993

[30] Foreign Application Priority Data

Apr. 24, 1992 [FR] France ..... 92 05087

[51] Int. Cl.[5] ..... B25C 1/14

[52] U.S. Cl. ..... 227/9; 227/10; 227/8

[58] Field of Search ..... 227/8, 9, 10, 11, 130, 227/147; 60/632, 635, 638

[56] References Cited

U.S. PATENT DOCUMENTS

| | | | |
|---|---|---|---|
| 2,804,620 | 9/1957 | Gannon | 227/9 |
| 2,970,314 | 2/1961 | Temple et al. . | |
| 3,321,122 | 5/1967 | Seghezzi et al. | 227/10 |
| 3,357,617 | 12/1967 | Osborne . | |
| 3,675,838 | 7/1972 | Bakoledis | 227/8 |
| 3,871,565 | 3/1975 | Termet . | |
| 4,210,267 | 7/1980 | Combette et al. . | |
| 4,349,141 | 9/1982 | Ollivier et al. . | |
| 4,565,312 | 1/1986 | Berry | 227/8 |

*Primary Examiner*—Eugenia Jones
*Assistant Examiner*—Allan M. Schrock
*Attorney, Agent, or Firm*—Schwartz & Weinrieb

[57] ABSTRACT

The apparatus comprises a barrel (1), a plunger (4) movable in the barrel for driving a fixing element (6), a plunger return catch (9), an element guide (21) mounted pivotably at the front of the barrel in order to load an element (6) therein from the rear to the front. The guide (21) is movable in axial translation relative to the barrel (1) and can move back into the firing position towards the barrel (1) and cover the front end of the recess (13) of the plunger (4), in order to then cover the head (14) of a fixing element (6) previously introduced into the guide (21).

The apparatus of the invention is well adapted to the application of plugs in steel or concrete materials.

16 Claims, 2 Drawing Sheets

APPARATUS FOR APPLYING FIXING ELEMENTS, WITH PLUNGER, PLUNGER RETURN CATCH AND PIVOTING PLUG GUIDE

FIELD OF THE INVENTION

The present invention concerns an apparatus for the application of fixing elements, comprising a barrel, a plunger movable in the barrel under the action of combustion gases of a propellant charge for driving a fixing element, a plunger return catch, and an element guide mounted at the front of the barrel for pivoting about a shaft orthogonal to the axis of the barrel and being able to load an element therein from the rear to the front.

BACKGROUND OF THE INVENTION

In most apparatus for applying or sealing fixing elements or plugs, particularly in steel or concrete substrate materials, loading of the plugs is carried out from the front or the muzzle of the apparatus and it is not always satisfactory. Just before firing, the plugs are in fact already in contact with the substrate material, and not with the plunger or piston of the firing or driving apparatus, so that at the moment of firing, no initial speed is imparted to the plugs.

Apparatus have already been proposed which reduce this drawback, with loading of the plugs from the rear to the front, through means of an opening formed in the barrel. But this solution does not offer sufficient guidance and safety.

The best solutions proposed up to now are those of apparatus provided with a tilting plug guide, like those of FR-A-1531056, U.S. Pat. No. 4,349,141, FR-A-2409826.

The apparatus of FR-A-2409826, which is in fact an indirectly fired apparatus with a plunger and a plunger return catch, comprises a plug guide mounted on a cap screwed into the barrel and pivoting automatically under the action of a sleeve, for operating, opening, and closing the barrel, slidably mounted on the cap.

The apparatus of U.S. Pat. No. 4,349,141, which is in fact also an indirectly fired apparatus with a plunger, but not with a plunger return catch, comprises a plug guide mounted for pivoting automatically in a sleeve, for operating, opening, and closing the barrel, slidably mounted on the barrel. It is the plug guide which, during closure, returns the plunger to the firing position.

The apparatus of FR-A-1531056 is also an indirectly fired apparatus with a plunger, with a plug guide mounted for pivoting on a sleeve mounted slidingly on the barrel, and without a return catch, the plunger being returned to the firing position during closure by means of the fixing elements themselves.

These last types of apparatus are well suited to fixing so-called "rivet head" plugs, which can be driven at a non-zero initial speed by means of a plunger of large rod cross-section, the same as that of the plug heads, which is favourable to proper fixing. But they are much less well adapted to plugs provided with a screw thread, or with a threaded head, and particularly with a threaded head of small cross-section. In this case, the plugs must be raised by a guide cap which does not always fully fulfil its role and which is often difficult to withdraw after fixing. Alternatively, the throughput cross-section of the plug guide as well as the cross-section of the plunger rod can be reduced correspondingly, but with the risk of the plunger rod then twisting at the moment of firing.

FR-A-2336216 is arranged so as to provide a solution to the problem of propulsion of threaded plugs, in so far as it comprises a plunger rod of which the front end is hollowed out to receive the threaded heads of the plugs and thus ensure, at the time of firing, guidance and initial speed.

But the supply of a fixing element in the apparatus of FR-A-2336216 is carried out by means of its muzzle with the aid of a tiltably mounted thruster, which requires a manual operation on the part of the operator.

OBJECT OF THE INVENTION

The present invention aims to propose an apparatus combining the advantages of those of the prior art presented above without having their disadvantages.

SUMMARY OF THE INVENTION

For this, the applicant tried to improve the apparatus of the type of FR-A-2409826 mentioned at the beginning of the BACKGROUND section of this patent application. Shaping the plunger of this apparatus like that of the apparatus of FR-A-2336216 was not enough to ensure guidance of the elements, the head of which would have remained on the outside of the plunger rod at the moment of firing. The problem was to make the element guide move back towards the barrel and plunger, and to make it movable in axial translation relative to the barrel, as in the apparatus of U.S. Pat. No. 4,349,141. But in the latter apparatus, in which the element guide is arranged so as to move back towards the barrel in order to allow cocking, at the moment of bearing and firing, the head of the fixing element still remains on the outside of the plunger, since it is the guide which returns the plunger to the firing position. Furthermore, the apparatus is one in which the relative position of the front of the plunger in relation to the front of the barrel does not shift, in order to allow the closing movement of the guide or return of the plunger.

Finally, the present invention concerns an apparatus of the type mentioned at the beginning of the BACKGROUND section of this patent application, characterised in that the element guide is movable in axial translation relative to the barrel and arranged so as to move back into the firing position towards the barrel and cover the front end of the shaped plunger, in order to then cover the head of a fixing element previously introduced into the guide.

The apparatus of the invention thus ensures perfect guidance and initial speed of the fixing elements, including fixing elements with threaded heads.

The invention applies particularly well to an apparatus with adjustment of power, that is, with the plunger position adjustable relative to the barrel at the moment of firing, such as for example of the type described in FR-A-2620368.

Preferably, the element guide is movable in translation in a rocker mounted pivotably on a shaft, which passes through an operating sleeve mounted slidingly on the barrel and a cap fixed to the barrel, and arranged so as to receive the element guide.

Advantageously, there is provided a tilt lever which is rigidly connected to the cap in translation and on which the operating sleeve is mounted slidingly.

Also advantageously, there are provided means disposed in the operating sleeve and arranged so as to cooperate with the cap in order to keep the sleeve in the open position temporarily, as well as other means disposed in the operating sleeve and arranged so as to cooperate with the cap in order to limit the sliding of the sleeve.

Preferably, the rocker comprises tilt means arranged so as to cooperate with a cam of the tilt lever and tilt the rocker under the action of the sliding of the operating sleeve on the tilt lever.

BRIEF DESCRIPTION OF THE DRAWINGS

The invention will be understood better with the aid of the following description of the preferred embodiment of the apparatus with reference to the attached drawings, in which similar reference characters designate like or corresponding parts of the invention throughout the several views, wherein.

DETAILED DESCRIPTION OF THE PREFERRED EMBODIMENT

Figure 1:
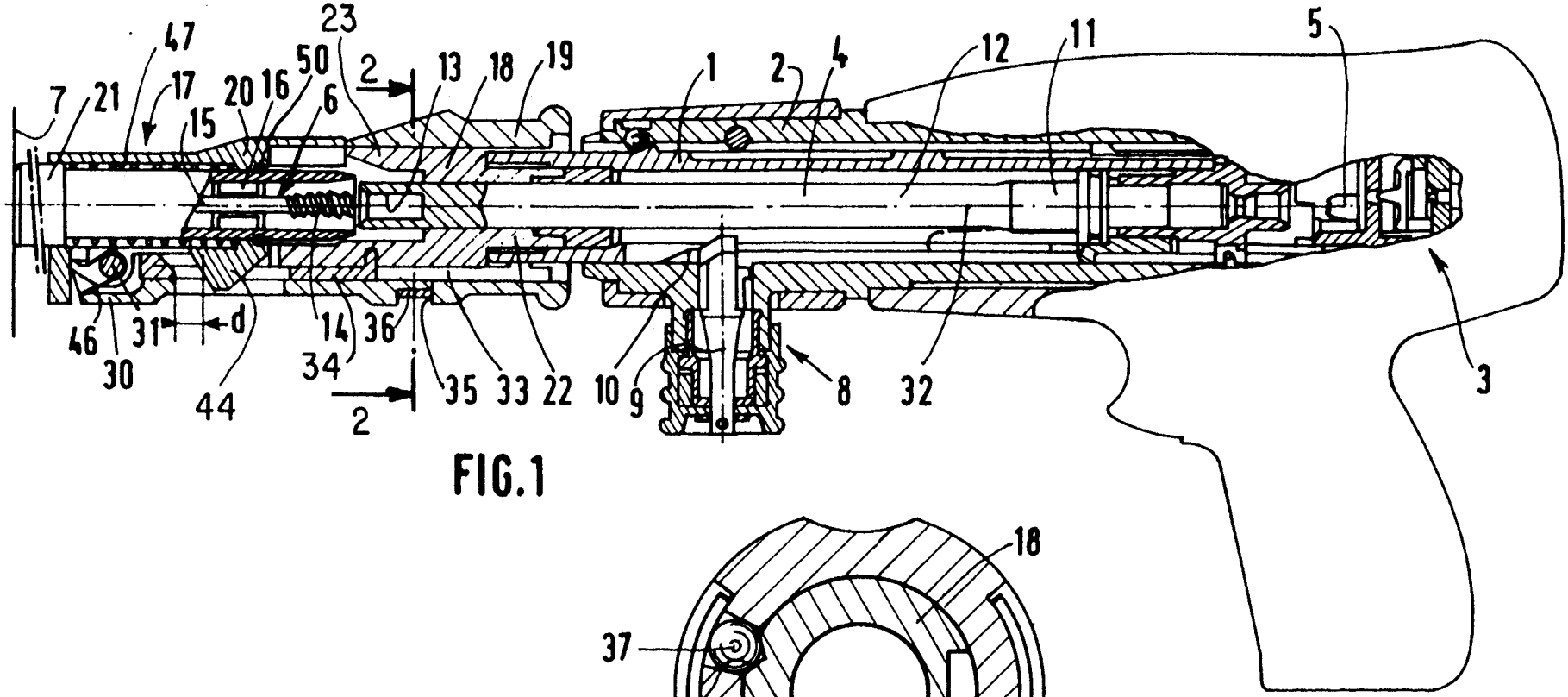
FIG. 1 is a view in axial section of the apparatus, in the closed position, ready for cocking.

The apparatus for applying fixing elements, as shown in the drawings, is an apparatus similar to the one which is described in the document FR-A-8712755 to which the reader will therefore kindly refer for fuller details.

The apparatus includes a barrel 1 mounted slidingly in a barrel holder 2, a firing mechanism 3 and a plunger 4 mounted slidingly in the barrel 1 in order, under the action of the combustion gases of a propellant charge 5, to drive a fixing element or plug 6 into a substrate material 7 intended to receive it.

The apparatus is provided with plunger return means 8 including a return catch 9 and an associated set of milled portions 10 on the barrel 1. The plunger 4 comprises a head 11 and a rod 12 of which the front end comprises a recess 13 for receiving the heads 14 of the plugs 6. In this particular case the plug 6 shown in FIGS. 1 and 3 has a threaded head 14 extended by a rod 15 bearing a retaining and guide washer 16. The apparatus also comprises, at the front of the barrel 1, a plug guiding and cocking assembly 17 which comprises a cap 18, an operating sleeve 19, a rocker 20 and an element guide or plug guide 21 mounted in the rocker 20 so as therefore to be able to be tilted and receive a plug 6 introduced from the rear to the front.

The cap 18 comprises at the rear a narrow externally threaded portion 22 screwed into the front portion of the barrel. Provided with a bore for passage of the plunger, substantially of the same cross-section as the latter, the cap 18 comprises a wide front opening portion 23 for receiving the plug guide 21 (FIG. 3).

Figure 5:
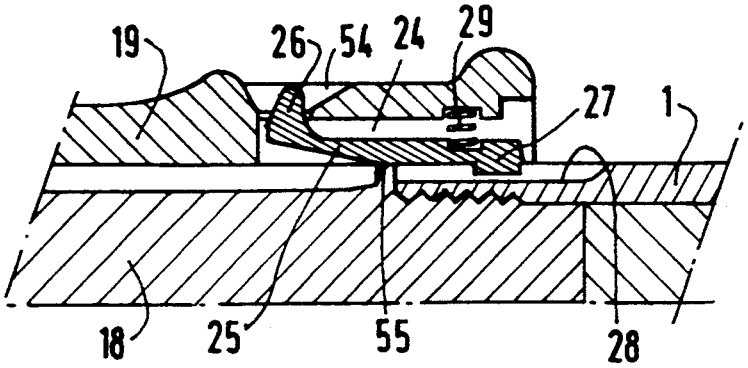
FIG. 5 is a view in axial section of the mounting bolt the assembly of FIGS. 3 and 4.

The sleeve 19 is mounted slidingly on the cap 18 and the barrel 1. In the sleeve (FIG. 5) is formed a recess 24 for receiving a mounting bolt 25 wherein the recess 24 is open at the rear for introduction of the bolt, and wherein further the recess 24 opens laterally outwardly by means of an opening 54 for passage of the bolt head 26. The bolt 25 in the form of a lever is provided with a foot 27 engaged in a groove 28 of the barrel 1 under the action of a spring 29. The bolt 25 ensures locking of the sleeve 19 in connection with the rotation on the barrel 1.

Figure 2:
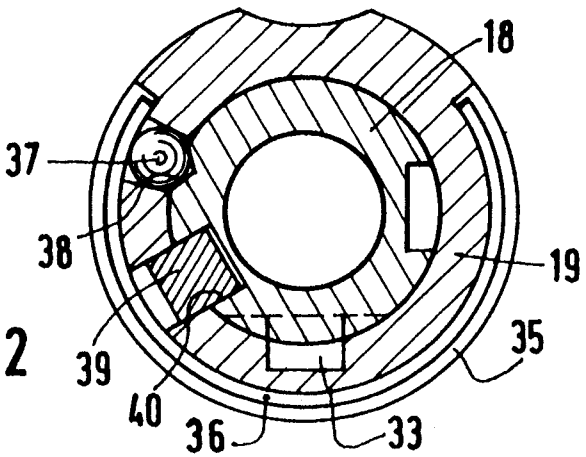
FIG. 2 is a view in cross-section along the line 2—2 of FIG. 1.
Figure 4:
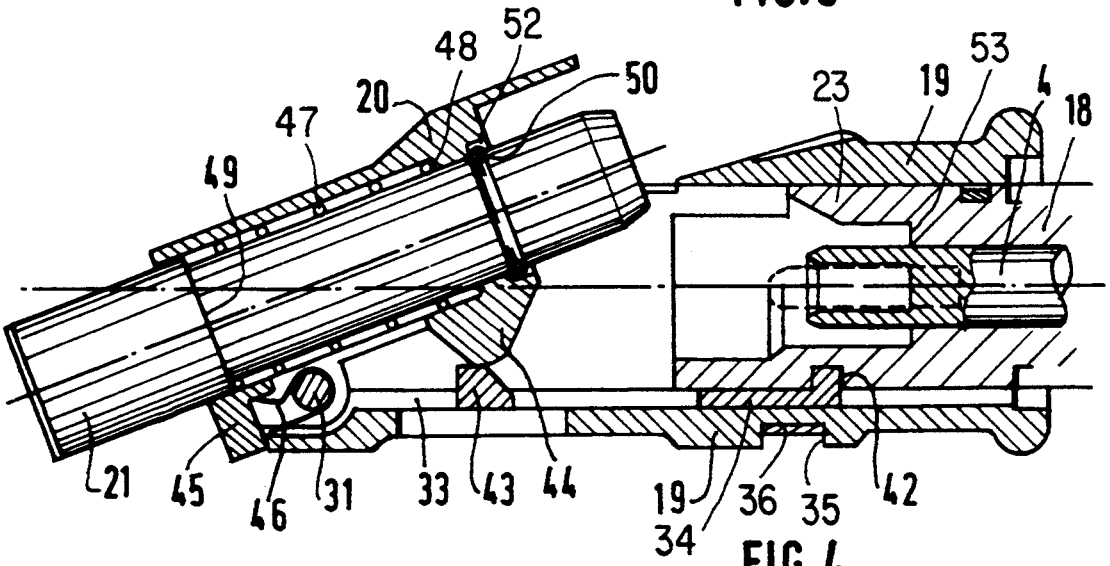
FIG. 4 is a view in axial section of the assembly of FIG. 3, in the open position.

The sleeve 19 at the front 30 is in the form of a U-shaped trough through which passes a shaft 31 orthogonal to the axis of the barrel 1, on which is mounted the rocker 20. A groove 33 (FIG. 4) is formed in the sleeve 19 for relative sliding of a tilt lever 34 in the sleeve 19. The sleeve 19 also comprises a peripheral groove 35 in which is disposed a spring washer 36 for maintaining a ball 37 accommodated in an orifice of the sleeve but capable of projecting into an indentation 38 of the cap 18 in order to keep the sleeve 19 temporarily on the cap 18 in a well-defined open position (FIGS. 2 and 4). A thruster 39 accommodated in another orifice of the sleeve 19 and subjected to the action of the washer 36 projects into a groove 40 of the cap 18 in order to connect the sleeve and cap rigidly in rotation and limit the stroke of sliding of the sleeve on the cap (FIG. 2).

Figure 3:
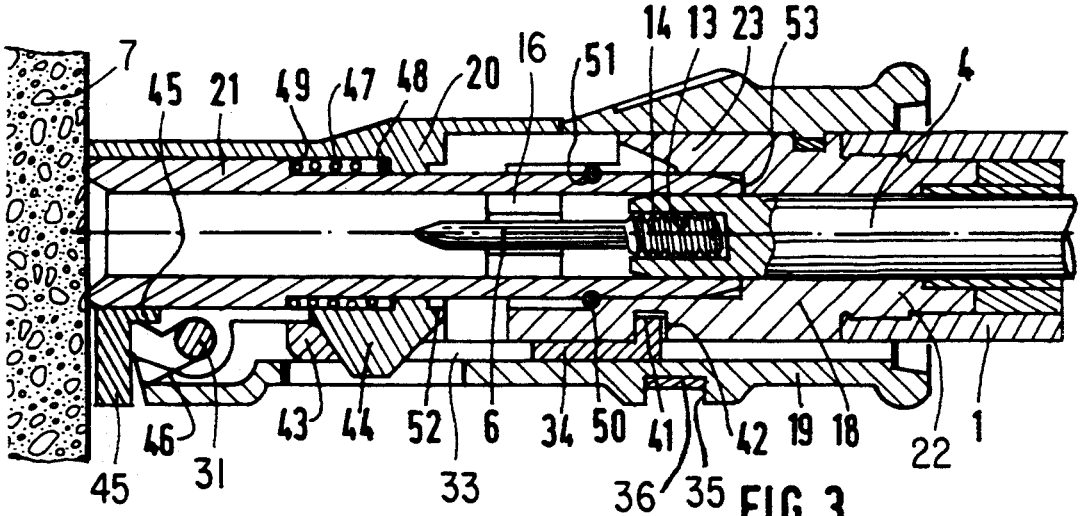
FIG. 3 is a view in axial section of the plug guiding and cocking assembly of the apparatus of FIG. 1, in the bearing position, ready for firing.

The lever 34, which can slide in the groove 33 of the sleeve, has at the rear a angled foot 41 engaged in a groove 42 of the cap 18 in order to connect the lever, the cap and the barrel rigidly in sliding, and at the front a cam 43 for pivoting of the rocker 20 (FIG. 3).

The rocker 20 mounted pivotably about the shaft 31 of the sleeve 19 comprises a wide peripheral rib 44 for cooperating with the cam 43 of the lever 34 in order to cause tilting thereof, and a transverse end skirt portion 45 forming a shoulder for supporting a spring 46 for return to the untilted position of the rocker 20 (FIG. 3).

The rocker 20 comprises a bore for passage of the plug guide 21, both with double diameter, inside and outside respectively, for receiving a return spring 47 bearing on an annular inner rear shoulder 48 of the rocker and an annular outer front shoulder 49 of the plug guide 21 (FIG. 3).

At the rear, the plug guide 21 carries a spring washer 50 in a transverse peripheral groove 51, serving to limit sliding.

The plug guide 21 is freely rotatable within the rocker 20 and is also slidably mounted therein, the guide 21 and rocker 20 assembly being movable together between an open tilted or inclined position as seen in FIG. 4 and a closed untilted position as seen in FIG. 3. Return spring 47 normally biases the guide 21 to an extended position as seen in FIG. 4 until washer 50 abuts the bottom of the groove 52 of the rocker 20, whereas the plug guide 21 may be moved rearwardly against the bias of spring 47, as seen in FIG. 3, as a result of the forward end of the plug guide 21 being engaged with the substrate 7 and the apparatus being moved forwardly, the rearward movement of the plug guide 21 being limited by means of the rear end portion of the plug guide 21 abutting or engaging the shoulder portion 43 formed within the open end portion 23 of the cap 18.

In FIG. 1 the apparatus is shown in the closed position, ready for cocking. A plug 6 has been engaged in the plug guide 21 and the rocker 20 has been moved to its non-tilted position by the spring 46 in the extension of the barrel 1. The ball 37, by rearward return of the operating sleeve 19, has come out of the indentation 38 of the cap 18, enabling relative sliding of the sleeve 19, and hence of the rocker 20, and of the cap 18, and hence of the lever 34, in order to disengage the rib 44 of the rocker 20 from the cam 43 of the lever 34. In this movement, the plug guide 21 has come closer to the front of the plunger 4 by a distance d corresponding substantially to the power adjusting stroke to which the plunger is subjected, shown here as the maximum power.

In FIG. 3 the apparatus is shown in the position of bearing on the substrate 7, ready for firing. The plug guide 21 has been thrust back to the rear, first abutting against the cap 18, then beyond such position in order to entrain the cap and the barrel with it into the cocking position of the firing mechanism 3. The plug 6 held by the washer 16 has been introduced by its head into the front recess 13 of the plunger 4, until abutting against the bottom of the recess.

In FIG. 4 the apparatus is shown in the open position in which a fixing element can be introduced into the plug guide 21. In order to perform an opening movement intended in particular for repositioning the plunger 4 with the aid of the catch 9, the user, having grasped the sleeve 19, pulls it towards the front. In this movement, the plunger 4 moves back in the barrel 1 (in fact, it is the barrel which moves forwards), the sleeve 19 slides forwards over the cap 18 and the barrel 1 until the thruster 39 is in abutment against the bottom front of its groove 40 and the ball 37 has returned into engagement with the indentation 38 of the cap 18, and the plug guide 21 under the action of the spring 47 escapes the plunger 4 and the cap 18. In the course of this opening movement, the lever 34 with its cam 43 has, against the action of the spring 46, tilted the rocker 20 by its rib 44. The apparatus is then kept in this open position by the ball 37 engaging with the indentation 38, under the action of the washer 36.

If it is wished to dismount the apparatus, it is enough to displace the head 26 of the bolt 25 outside the opening 54 and pivot the bolt, against the action of the spring 29, about a projection 55 of the cap, here adjacent to the thread 22 of the cap portion 18, in order to disengage the foot 27 from the groove 28 of the barrel and thus be able to move the bolt out of its recess 24.

In light of the above teachings, various changes and modifications to the present invention are possible. It is therefore to be understood that within the scope of the appended claims, the present invention may be practiced otherwise than as specifically described herein.

We claim:

1. Apparatus for inserting a fastening element into a substrate, comprising:

a barrel (1);

a propellant charge (5) disposed rearwardly of said barrel (1);

a plunger (4) movable within said barrel (1) under the action of combustion gases of said propellant charge (5) for driving a fastening element (6) into a substrate (7), said plunger (4) having a recess (13) defined within a front end portion thereof for receiving a head portion (14) of said fastening element (6);

a rocker (20) pivotably mounted upon said barrel (1), about a shaft (31) disposed orthogonally to a longitudinal axis (32) of said barrel (1), between a first open position at which said rocker (20) has an axis thereof inclined with respect to said axis (32) of said barrel (1) for receivably loading a fastening element (6) into said apparatus, and a second closed position at which said rocker 20 and said fastening element (6) loaded within said apparatus are coaxially disposed with respect to said axis (32) of said barrel (1); and an element guide (21) disposed within said rocker (20) so as to be pivotably movable therewith, between said first and second positions, and also being movable in axial translation relative to said rocker (20) and said barrel (1) as a result of a first end portion of said element guide (21) being pressed against said substrate, said element guide being axially movable between said second closed position at which said fastening element (6) is loaded within a second end portion of said element guide (21) and a third firing position at which said head portion (14) of said fastening element (6) is disposed within said recess (13) of said plunger (4) and said second end portion of said element guide (21) surroundingly envelops said front end portion of said plunger (4) within which said recess (13) is defined and within which said head portion (14) of said fastening element (6) is disposed, so as to accurately guide said plunger (4), and said fastening element (6) disposed within said recess (13) thereof, during said third firing position.

2. Apparatus according to claim 1, in which the element guide (21) which passes through an operating sleeve (19) mounted slidingly on the barrel (1) and a cap (18) fixed to the barrel (1) and arranged so as to receive the element guide (21).

3. Apparatus according to claim 2, in which there is provided a mounting bolt (25) arranged so as to lock the operating sleeve (19) on the barrel (1).

4. Apparatus according to claim 2, in which there is provided a tilt lever (34) which is rigidly connected to the cap (18) in translation and on which the operating sleeve (19) is mounted slidingly.

5. Apparatus according to claim 4, in which the rocker (20) comprises tilt means (4) arranged so as to cooperate with a cam (43) of the tilt lever (34) and tilt the rocker (20) under the action of sliding of the operating sleeve (19) relative to the tilt lever (34).

6. Apparatus as set forth in claim 5, wherein:

said tilt means (44) comprises a cam follower.

7. Apparatus as set forth in claim 6, wherein:

said cam follower comprises an enlarged rib peripherally disposed about said rocker (20).

8. Apparatus according to any of claim 2, in which there are provided means (37) disposed in the operating sleeve (19) and arranged so as to cooperate with the cap (18) in order to keep the sleeve (19) in an open position.

9. Apparatus according to claim 8, in which there are provided other means (39) disposed in the operating sleeve (19) and arranged so as to cooperate with the cap (18) in order to limit sliding of the sleeve (19).

10. Apparatus according to claim 2, in which the element guide (21) is movable in translation in the rocker (20) against the action of return means (47), and means (50, 51) are provided for limiting sliding of the element guide (21) into the open position.

11. Apparatus as set forth in claim 10, wherein:

said return means (47) comprises a coil spring disposed about said element guide (21) and within said rocker (20).

12. Apparatus as set forth in claim 10, wherein:

said limiting means (50,51) comprises a spring washer (50) disposed within a peripheral groove (51) defined upon said element guide (21) for engaging a shoulder portion (52) defined upon said rocker (20).

13. Apparatus according to claim 2, in which the rocker (20) is mounted on the operating sleeve (19) so as to pivot into the open position against the action of a return means (46).

14. Apparatus as set forth in claim 13, wherein:

said return means (46) comprises a spring.

15. Apparatus as set forth in claim 14, wherein:

said spring (46) is disposed about said shaft (31) of said operating sleeve (19).

16. Apparatus according to claim 1, in which the position of the plunger (4) in the barrel (1) is adjustable in order to adjust the power of the apparatus.

* * * * *